US005161839A

United States Patent [19]

Piltingsrud et al.

[11] Patent Number: 5,161,839

[45] Date of Patent: Nov. 10, 1992

[54] CHECK RAIL LOCK AND METHOD OF MAKING CHECK RAIL LOCK PAINTABLE AFTER ASSEMBLY

[75] Inventors: Stephen M. Piltingsrud; Donald L. Anderson, both of Owatonna, Minn.

[73] Assignee: Truth Division of SPX Corporation, Owatonna, Minn.

[21] Appl. No.: 735,903

[22] Filed: Jul. 25, 1991

[51] Int. Cl.[5] ..... E05C 3/04

[52] U.S. Cl. ..... 292/241; 292/DIG. 53; 292/348; 292/DIG. 47

[58] Field of Search ..... 292/240, 241, 348, 353, 292/202, DIG. 38, DIG. 47, DIG. 53, DIG. 64; 74/548

[56] References Cited

U.S. PATENT DOCUMENTS

| | | | |
|---|---|---|---|
| 3,811,718 | 5/1974 | Bates | 292/241 |
| 4,186,952 | 2/1980 | Glass | 292/DIG. 53 |
| 4,436,328 | 3/1984 | Chernosky | 292/241 |
| 4,621,847 | 11/1986 | Paulson et al. | 292/241 |
| 4,736,972 | 4/1988 | Mosch | 292/241 |
| 4,801,164 | 1/1989 | Mosch | 292/241 |
| 4,813,725 | 3/1989 | Mosch | 292/DIG. 53 |

*Primary Examiner*—Eric K. Nicholson
*Attorney, Agent, or Firm*—Wood, Phillips, Van Santen, Hoffman & Ertel

[57] ABSTRACT

A check rail lock including a housing with a pivot opening, a handle having a pivot shaft extending through the pivot opening, the handle being disposed over the housing when operably pivoted between locking and unlocking positions, and a cam secured to the pivot shaft beneath the housing with a post extending toward the housing. A C-shaped spring mounted to the housing between the housing and the cam has shoulders which (1) allow the spring to flex outwardly to allow passage of the post past one of the shoulders when pivoting the handle from a painting position extending away from the housing to either operational locking or unlocking position and (2) stop the handle from being pivoted beyond the locking or unlocking positions to the painting position. Recesses in the spring adjacent the shoulders positively indicate when the lock is in either the locked or unlocked positions. A method of manufacturing a check rail lock is also disclosed, including the steps of (1) pivotally mounting a handle to a housing with a pivot shaft through the housing so that the handle projects away from the housing toward a painting position covering a minimal amount of the housing, (2) securing a cam to the pivot shaft, (3) painting the handle and housing, and (4) pivoting the handle to an operational condition in which the handle is permanently prevented from being pivoted back to the painting position.

17 Claims, 2 Drawing Sheets

Fig. 3
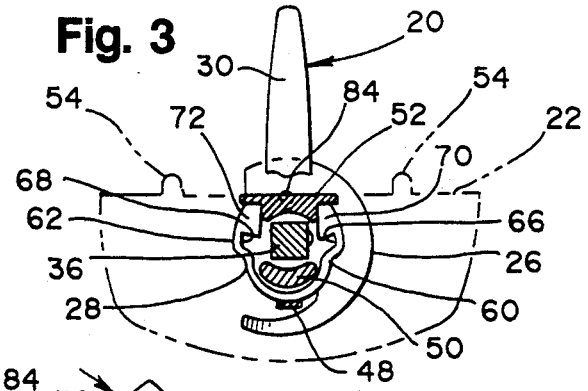
Fig. 4
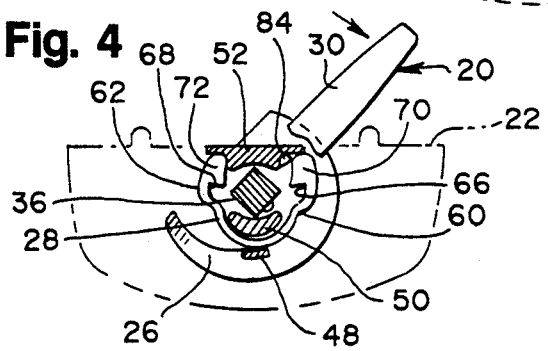
Fig. 5
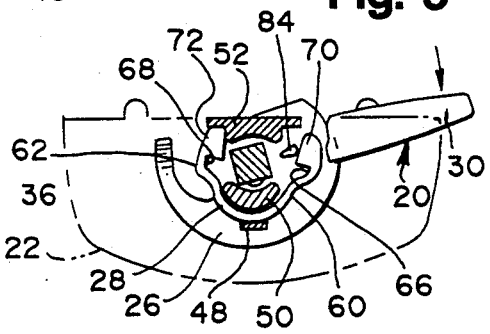
Fig. 6
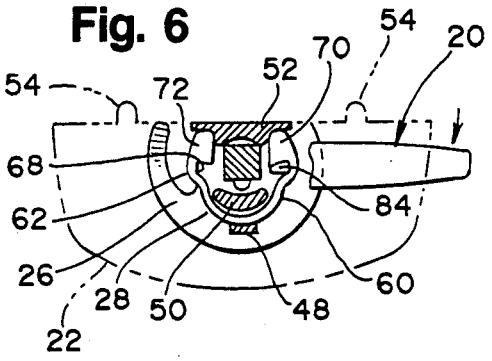
Fig. 7
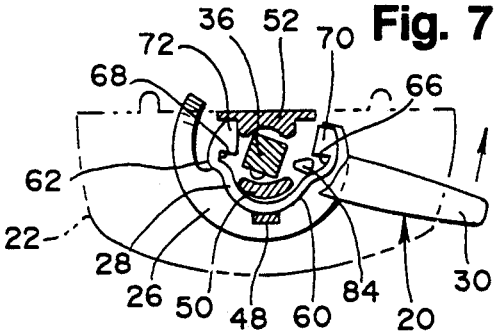
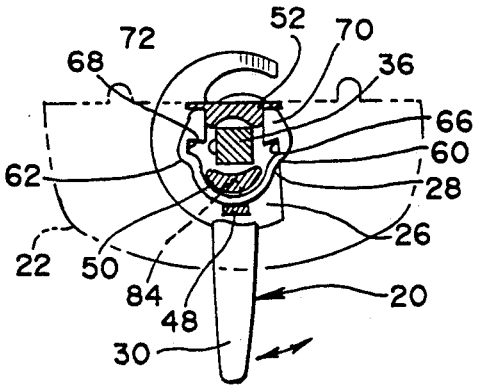
Fig. 8
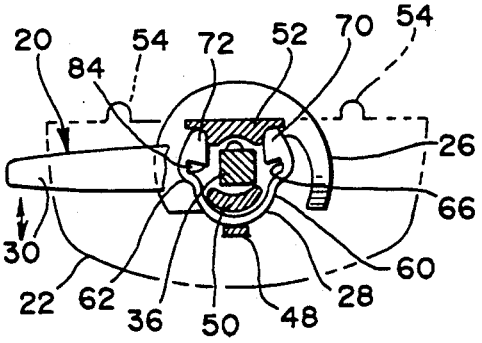
Fig. 9

CHECK RAIL LOCK AND METHOD OF MAKING CHECK RAIL LOCK PAINTABLE AFTER ASSEMBLY

BACKGROUND OF THE INVENTION

1. Technical Field

The present invention is directed toward check rail locks, and more particularly toward check rail locks which may be painted after the locks are assembled.

2. Background Art

Check rail locks for use in locking dual sash windows are well known in the art. A typical type of such lock includes a keeper on the upper sash and a lock on the lower sash, where the lock includes a cam which may be pivoted to extend out and grasp the keeper to lock the two sashes against opening. Locks of this general type are shown, for example, in commonly owned Bates U.S. Pat. No. 3,811,718.

Similar operation is also provided in prior art check rail locks in which the cam is enclosed in a housing for protection and aesthetic reasons, and a handle located on top of the housing is connected to the cam so that pivoting of the handle will cause the cam to extend from (or retract into) the housing for grasping (or releasing) the keeper. Such locks are shown, for example, in commonly owned Mosch U.S. Pat. Nos. 4,736,972, 4,801,164, and 4,813,725.

Of course, for different installations, different colors are desired. Therefore, it is necessary to paint the visible components of the lock and keeper different colors in order to provide the variety of locks needed for all installations. Heretofore, with locks having a housing and handle, painting of the components has required that the handles and housings be separately painted in order to ensure that the housing does not have a paint shadow beneath the handle as positioned during painting. Such painting requirements therefore introduce a cost element into the manufacture of such locks. For example, a strict inventory of parts must be maintained in order to ensure that matching amounts of handles and locks are painted each color, and the extent of handling of the many different components is maximized. As a practical matter, this can also increase manufacturing costs by requiring that painting be accomplished before assembly (e.g., by foreclosing use of an inexpensive facility which manufactures and assembles components but does not paint them). Still further, painting individual components prior to assembly introduces a risk that the painted finish will be scratched or otherwise damaged when handled during assembly.

Of course, it is desirable that all locks operate smoothly over a long life and provide reliable security.

The present invention is directed toward overcoming one or more of the problems set forth above.

SUMMARY OF THE INVENTION

In one aspect of the present invention, a check rail lock in provided including a housing with a pivot opening, a handle having a pivot shaft extending through the pivot opening, the handle being disposed over the housing when operably pivoted between locking and unlocking positions, and a cam secured to the pivot shaft beneath the housing. The handle and cam are mounted relative to the housing so that the handle may initially be positioned extending away from the housing during assembly for painting, and may then be pivoted from the painting position to either the locking or the unlocking position for operation where the handle is thereafter prevented from being pivoted back to the painting position.

In another aspect of the present invention, the cam is provided with a post extending toward the housing, and a spring is mounted to the housing between the housing and the cam. The spring allows the post to pivot past the spring when the handle is pivoted from the painting position to either the locking or unlocking position. The spring further includes shoulders associated with the locking and unlocking positions, and the spring (1) flexes outwardly to allow passage of the post past one of the shoulders when pivoting the handle from the painting position to either the locking or unlocking position, and (2) positions the shoulders to engage the post to stop the handle from being pivoted beyond the locking or unlocking positions to the painting position.

In still another aspect of the present invention, a detent is provided to positively indicate that the lock is in either the locked or unlocked positions. The detent consists of recesses in the spring, and the spring is biased against the post during operational pivoting between the locking and unlocking positions with the post received in the associated one of the recesses when the lock is in either the locking or unlocking position.

In yet another aspect of the present invention, the spring is C-shaped with two legs connected by a middle portion, the middle portion being anchored to the housing between the housing and the cam, with the detents and the shoulders being located on the spring legs.

Another aspect of the present invention is a method of manufacturing a check rail lock, including the steps of (1) pivotally mounting a handle to a housing with a pivot shaft through the housing so that the handle projects away from the housing toward a painting position covering a minimal amount of the housing, (2) securing a cam to the pivot shaft, (3) painting the handle and housing, and (4) pivoting the handle to an operational condition in which the handle is permanently prevented from being pivoted back to the painting position.

Still another aspect of the present invention includes the above manufacturing method in which the handle is pivotally mounted adjacent one side of the housing, and in its painting position is mounted at substantially 90° to the one housing side, whereby the handle is pivoted at least about 90° when pivoted from the painting position to an operational condition.

It is an object of the invention to provide a check rail lock with consistent and aesthetically pleasing painted surfaces.

It is another object of the present invention to provide check rail locks in any number of different colors with minimal handling of the individual components and minimal risk of damage to the painted surfaces.

It is another object of the present invention to provide an efficiently and inexpensively manufactured check rail lock.

It is still another object of the present invention to provide a check rail lock which operates smoothly and provides a positive feel to indicate when it is properly positioned for locking and unlocking. It is yet another object to provide a check rail lock which lasts over the long life commonly desired of window locks, all the while providing reliable security.

BRIEF DESCRIPTION OF THE DRAWINGS

FIGS. 3 to 9 are partially broken, cross-sectional plan views from above the check rail lock of the present invention, showing the housing in phantom, where:

FIG. 3 shows the lock in the paintable position,

FIGS. 4 and 5 show the lock in intermediate positions as the handle is turned away from the paintable position, FIG. 6 shows the lock in its operative, unlocked position, FIGS. 7 and 8 show the lock in intermediate positions as the handle is turned between operative locked and unlocked positions, and FIG. 9 shows the lock in its operative, locked position.

DESCRIPTION OF THE PREFERRED EMBODIMENT

Figure 1:
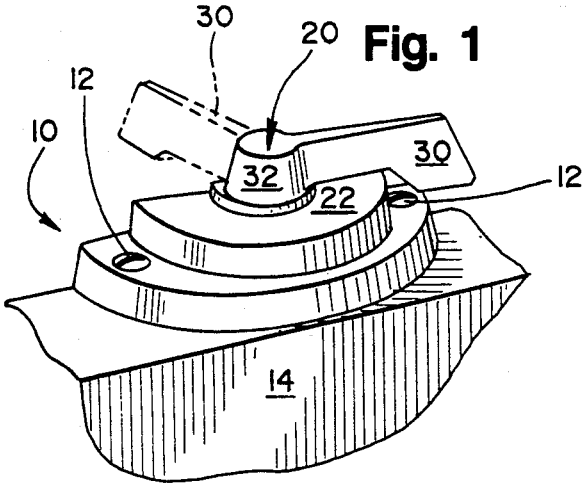
FIG. 1 is a perspective view of a check rail lock embodying the present invention, showing the handle in phantom in its paintable position.

A check rail lock 10 is shown in FIG. 1 suitably secured by screws 12 to the lower sash 14 of a dual sash window. The lock 10 includes a handle 20 pivotally mounted to a housing 22 for operation as described in more detail hereafter. Generally, as is well understood in the art, this lock 10 and those like it grasp (or release) a keeper (not shown) on the upper sash of dual sash windows to lock the two sashes closed by preventing relative movement (or allow the window to be opened by allowing either or both sashes to be moved).

Figure 2:
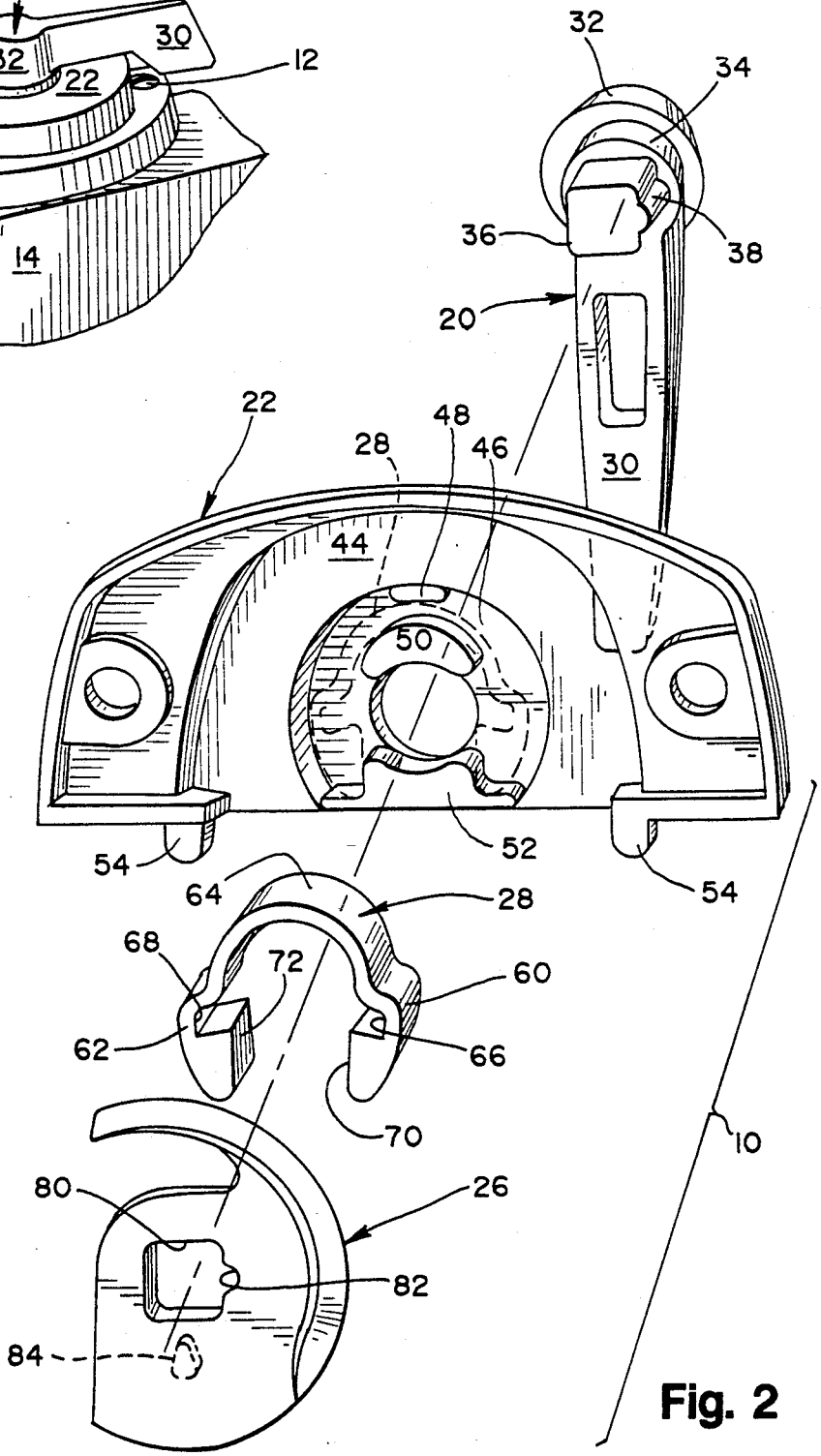
FIG. 2 is an exploded perspective view of the check rail lock of FIG. 1.

As shown in detail in FIG. 2, the lock 10 consists of essentially four major components: the handle 20, the housing 22, a cam 26, and a C-shaped spring 28. Typically, the handle 20, housing 22, and cam 26 are die cast zinc.

The handle 20 includes a handle portion 30, a head portion 32, and a pivot shaft 34 with a cam mounting portion 36. The cam mounting portion 36 is non-circular, and preferably includes an alignment lug 38 to ensure proper alignment during assembly as discussed hereafter.

The interior of the housing 22 includes a cam recess 44 and a spring recess 46. The spring recess 46 includes raised spring mounting bosses 48, 50, 52. The housing 22 may also include alignment lugs 54 which are known for use in ensuring alignment of the housing and keeper when the window is closed.

The spring 28 is C-shaped with two legs 60, 62 connected by a middle portion 64, with an axial length somewhat greater than the depth of the spring recess 46. Each of the spring legs 60, 62 include a detent recess 66, 68 adjacent a shoulder portion 70, 72. The spring 28 may be made of any suitable material, although it has been found that plastic such as 33% glass-filled nylon 6/6 is suitable.

The spring 28 is located in the housing spring recess 46 with restraints at three locations: its middle portion 64 is between mounting bosses 48, 50 and the shoulder portions 70, 72 are on opposite sides of mounting boss 52. Preferably, when the spring 28 is relaxed, the shoulder portions 70, 72 are spaced a distance less than the width of the mounting boss 52 so that a biasing force toward closing the shoulder portions 70, 72 together exists when the spring 28 is mounted in the spring recess 46.

The cam 26 includes a central opening 80 receiving the cam mounting portion 36 of the handle pivot shaft 34. One side of the opening 80 includes a recess 82 for receiving the pivot shaft alignment lug 38 to ensure that the handle portion 30 and the cam 26 are properly oriented relative to one another when the lock 10 is assembled. The cam 26 may be secured to the cam mounting portion 36 by any suitable means, for example by pressing the mounting portion 36 to expand its end once the lock components are properly assembled together.

The cam 26 also includes a post 82 which extends toward the housing 22. As a result of the previously mentioned axial length of the spring 28, the spring 28 will extend into the plane within which the post 84 will rotate and therefore the spring 28 and the post 84 will engage one another during operation as described below.

Specifically, during initial assembly of the lock 10, the handle 20 is disposed in a painting position oriented relative to the housing such as shown in FIGS. 2 and 3 (and as in phantom in FIG. 1). Therefore, as is most apparent from FIG. 1, during painting, the housing 22 may effectively be completely painted with minimal shadow in the paint beneath the handle portion 30, inasmuch as the handle portion 30 is disposed over virtually none of the housing 22.

Once painting is completed, the lock 10 may be changed to an operational condition as illustrated in FIGS. 3–9.

Specifically, as handle 20 is pivoted clockwise as illustrated in FIGS. 3–9, the cam 26 and its post 84 are likewise pivoted clockwise (note that while clockwise pivoting is illustrated and discussed herein for illustration, it should be clear from the disclosure that this lock 10 can similarly be changed to an operational condition by counterclockwise pivoting as well).

Recall that the post 84 travels in a plane below the mounting bosses 48, 50, 52 and that the spring 28 projects into that plane of travel. Therefore, after initial pivoting, the post 84 will contact the shoulder portion 70 of one of the spring legs 60 as illustrated in FIG. 4.

Continued pivoting of the handle 20 will move the post 84 against the bias of the spring 28 as shown in FIG. 5 the spring 28 being mounted by the mounting bosses 48, 50, 52 so that the leg 60 can move outwardly, and the entire spring 28 can shift to that side to some degree as wall).

Once the handle 20 is pivoted sufficiently, the post 84 will pass the shoulder portion 70 and the spring leg 60 will snap back in so that the post is in the detent recess 66 as shown in FIG. 6. At this point, the lock 10 is in an operational condition, and specifically is in its unlocking position. Further, the side of the detent recess 66 adjacent the shoulder portion 70 is oriented over-center to the pivot axis so that it will not bend back out should the handle 20 have a counterclockwise force applied to it, and therefore the lock 10 is effectively permanently prevented from being pivoted past the unlocking position back to the painting position.

FIGS. 6–9 show the lock in various positions in its operational condition. Specifically, applying a clockwise force to the handle 20 in FIG. 6 causes the post 84 to engage the other side of the detent recess 66 and, due to the orientation of that side of the recess 66, the spring leg 60 bends out to allow the handle 20 to pivot as shown in FIG. 7.

Continued clockwise pivoting of the handle occurs, through the position shown in FIG. 8, until it reaches the opposite extreme operational position—the locking position shown in FIG. 9.

Since, as with the other leg 60, the side of the detent recess 68 adjacent the shoulder portion 72 is oriented over-center to the pivot axis, that spring leg 62 will also not bend out to allow the post 84 to pass as would be necessary for the handle 20 to be returned to the painting position. Thus, the lock 10 is also effectively permanently prevented from being pivoted past the locking position to the painting position, with the overall result being that the lock may be positioned for painting after assembly and then may be permanently placed in an operational condition as is desirable once the lock 10 is placed in commerce for use.

In addition to the above features, it should also be understood that the orientation of the detent recesses 66, 68 provides a desirable "feel" to the lock 10 when in use. Specifically, the spring leg 60 or 62 engaging the post 84 is biased inward against the post 84 and, when the handle 20 gets near either the unlocking or locking position, the taper of the side of the associated detent recess 66 or 68 in combination with the bias of the spring 28 bias the post 84 into the detent recess 66 or 68 (thus biasing the cam 26 and handle 20 into the unlocking or locking position).

Thus, the lock provides ideal operation. First, once the handle 20 is located near either of its two extreme operational positions (and it is basically always desirable that the lock 10 be left in one of those two positions), it is actually biased into that position. Second, the clicking of the spring leg 60 or 62 back into place once the post 84 is located in the detent recess 66 or 68 provides the above mentioned "feel" indicating to the operator that the lock 10 is properly positioned. Third, while the spring 28 allows the handle 20 to be pivoted from either the unlocking or locking positions when sufficient force is applied to the handle 20, it nevertheless provides enough force to keep the handle 20 in the desired position without danger of it inadvertently slipping out of either the unlocking or locking positions.

In summary, it should now be apparent to those having an understanding of the present invention that the disclosed lock 10 may be inexpensively manufactured in any different number of colors, where the visible portions of the lock have consistent and aesthetically pleasing painted surfaces. Further, in view of the manner in which the painting may be accomplished, inventory problems are reduced, handling of individual components may be minimized, and therefore risk of damage to any of the painted surfaces is minimized. Still further, all of these manufacturing advantages are provided in a lock providing ideal operation.

Still other aspects, objects, and advantages of the present invention can be obtained from a study of the specification, the drawings, and the appended claims.

What is claimed is:

1. A check rail lock for a window, comprising:

a housing with a pivot opening therethrough;

a handle on top of said housing and having a pivot shaft extending through said pivot opening, said handle being disposed over said housing when operably pivoted between locking and unlocking positions;

a cam secured to said pivot shaft beneath said housing;

means for allowing said handle to be positioned extending away from said housing during initial assembly of said lock for painting of said housing prior to installation of said lock to the window, and allowing said handle to be pivoted from said painting position to either said locking or said unlocking position; and means for preventing said handle from being pivoted from either said locking or unlocking positions toward said painting position.

2. The check rail lock of claim 1, further comprising detent means for positively indicating that said lock is in either the locked or unlocked positions.

3. The check rail lock of claim 1, wherein:

said allowing means comprises a post secured to said cam and extending toward said housing, and a spring mounted to said housing between said housing and said cam and allowing said post to pivot past said spring when said handle is pivoted from said painting position to either said locking or unlocking position; and said preventing means comprises shoulders on said spring associated with said locking and unlocking positions, whereby said spring flexes outwardly to allow passage of the post past one of the shoulders when pivoting said handle from said painting position to either said locking or unlocking position, and positions said shoulders to engage the post to stop the handle from being pivoted beyond the locking or unlocking positions to the painting position.

4. The check rail lock of claim 3, further comprising detent means adjacent said shoulders for positively indicating that said lock is in either the locked or unlocked positions.

5. The check rail lock of claim 4, wherein said detent means comprises recesses in said spring whereby said spring is biased against said post during operational pivoting between said locking and unlocking positions and said post is received in the associated one of the recesses when the lock is in either the locking or unlocking position.

6. The check rail lock of claim 5, wherein the spring recesses are tapered so that said post engages and flexes said spring when said handle is operationally pivoted from either said locked or unlocked positions away from said shoulders.

7. The check rail lock of claim 1, wherein the pivot opening is adjacent one side of the housing and said handle is disposed at substantially 90° to said one housing side when in said painting position.

8. The check rail lock of claim 7, wherein the handle painting position is disposed at least about 90° from both said locking and said unlocking positions.

9. A check rail lock for a window, comprising:

a housing with a pivot opening therethrough;

a handle having a pivot shaft extending through said pivot opening, said handle extending away from the housing in a painting position during initial assembly of said lock prior to installation of said lock to the window, and extending over said housing when pivoting between extreme operational positions for locking and unlocking;

a cam secured to said pivot shaft and having a post projecting toward said housing;

a C-shaped spring with two legs connected by a middle portion, said middle portion being anchored to said housing between said housing and said cam, said legs having detent portions engageable with said post to provide a positive feel when said lock is in either extreme operational position, and stop shoulders for engaging said post to prevent said lock from being pivoted to said painting position from said operational positions, whereby said post distorts one of the spring legs to allow the post to pass the associated stop shoulders when the lock is pivoted from the painting position to an operational position.

10. The check rail lock of claim 9, wherein said detent portions comprise recesses in said spring, said spring biasing against said post so that said post is received in an associated one of the recesses when said lock is in either extreme operational position.

11. The check rail lock of claim 10, wherein the spring recesses are tapered so that said post engages and flexes one spring leg when said handle is operationally pivoted from either extreme operational position away from said shoulders.

12. The check rail lock of claim 9, wherein the pivot opening is adjacent one side of the housing and said handle is disposed at substantially 90° to said one housing side when in said painting position.

13. The check rail lock of claim 12, wherein the handle painting position is disposed at least about 90° from both of said extreme operational positions.

14. A check rail lock, comprising:

a housing with a pivot opening therethrough;

a handle having a pivot shaft extending through said pivot opening, said handle extending away from the housing in a painting position during initial assembly of said lock and extending over said housing during operational pivoting between locking and unlocking positions;

a cam secured to said pivot shaft and having a post projecting toward said housing;

a C-shaped spring secured to said housing between said housing and said cam and having opposite detent portions engageable with said post to provide a positive feel when said lock is in either the locking or unlocking positions, and stop shoulders on said spring for engaging said post to prevent said lock from being pivoted to said painting position from said locking and unlocking positions.

15. The check rail lock of claim 14, whereby said post distorts the spring to allow the post to pass one of the stop shoulders when the lock is pivoted from the painting position to an operational position.

16. The check rail lock of claim 14, wherein the pivot opening is adjacent one side of the housing and said handle is disposed at substantially 90° to said one housing side when in said painting position.

17. The check rail lock of claim 16, wherein the handle painting position is disposed at least about 90° from both of said locking and unlocking positions.

* * * * *